US005229243A

United States Patent [19]

Sasaki et al.

[11] Patent Number: 5,229,243

[45] Date of Patent: Jul. 20, 1993

[54] CAPSULATED TONER FOR HEAT PRESSURE FIXATION

[75] Inventors: Mitsuhiro Sasaki; Kuniyasu Kawabe, both of Wakayama, Japan

[73] Assignee: Kao Corporation, Tokyo, Japan

[21] Appl. No.: 833,502

[22] Filed: Feb. 11, 1992

[30] Foreign Application Priority Data

Feb. 26, 1991 [JP] Japan ..... 2-030849

[51] Int. Cl.[5] ..... G03G 9/093

[52] U.S. Cl. ..... 430/109; 430/137; 430/138

[58] Field of Search ..... 430/109, 137, 138

[56] References Cited

U.S. PATENT DOCUMENTS 4,628,019 12/1986 Suemetso et al. ..... 430/109
4,656,111 4/1987 Wakamiya et al. .
4,845,005 7/1989 Niki et al. ..... 430/109
4,977,052 12/1990 Mikani ..... 430/137

FOREIGN PATENT DOCUMENTS 0217337 4/1987 European Pat. Off. .
0225476 6/1987 European Pat. Off. .
0453857 10/1991 European Pat. Off. .
3407829 6/1984 Fed. Rep. of Germany .
2107892 5/1983 United Kingdom .

*Primary Examiner*—Marion E. McCamish
*Assistant Examiner*—Christopher D. RoDee
*Attorney, Agent, or Firm*—Birch, Stewart, Kolasch & Birch

[57] ABSTRACT

A capsulated toner for heat pressure fixation comprising a heat-meltable core material and an outer shell, said core material containing a colorant and a thermoplastic resin as a major constituent, produced by copolymerizing (A) an $\alpha,\beta$-ethylenically copolymerizable monomer having an amino group and (B) $\alpha,\beta$-ethylenically copolymerizable monomer other than (A), said outer shell being provided so as to cover the surface of the core material. When the capsulated toner of the present invention is used, the dependency of the amount of electrification upon the environment is small because the electrification can be regulated from within the capsulated toner. Further, because the offset resistance in a heat pressure fixation system, such as a heat roller, is excellent, the fixation can be conducted at a low temperature. Further, the blocking resistance is so good that a clear image, free from fogging, can be stably formed over a plurality of uses.

17 Claims, No Drawings

CAPSULATED TONER FOR HEAT PRESSURE FIXATION

FIELD OF THE INVENTION

The present invention relates to a capsulated toner for use in the development of an electrostatic latent image formed in the electrophotography, electrostatic printing and electrostatic recording, etc., and more particularly to a capsulated toner for heat pressure fixation, and further to an improvement in the toner described in Japanese Patent Laid-Open No. 14231/1991.

DESCRIPTION OF THE RELATED ART

As described in U.S. Pat. Nos. 2,297,691 and 2,357,809, conventional electrophotography comprises the steps of uniformly electrifying a photoconductive insulating layer, subjecting the layer to exposure, dissipating the charge on the exposed portion to form an electrical latent image, depositing a fine charged powder having a color called a toner to form a visual image (step of development), transferring the resultant visual image onto a transfer material, such as transfer paper (step of transfer), and permanently fixing the visual image by heating, pressure or other suitable fixation methods (step of fixation).

Thus, the toner should have a function required not only in the step of development but also in the steps of transfer and fixation.

In general, the toner is subjected to mechanical frictional force derived from shear force and impact force during the mechanical action in a development apparatus, and deteriorates during the copying of several thousands to several tens of thousands of sheets of paper. The use of a tough resin having a large molecular weight capable of withstanding the mechanical frictional force suffices for the prevention of the above-described deterioration of the toner. These resins generally have a high softening point, and thus satisfactory fixation cannot be conducted in an oven fixation process and a radiant fixation process by means of infrared radiation as the non-contact fixation system, due to its poor heat efficiency. Also in a heat pressure fixation system utilizing a heat roller, etc., which is one of the contact fixation systems which have been widely used by virtue of its good heat efficiency, it is necessary to raise the temperature of the heat roller for the purpose of attaining satisfactory fixation. This brings about unfavorable phenomena such as deterioration of the fixation apparatus, curling of paper and an increase in the consumption energy. Further, since the pulverizability of the above-described resin is so poor, the production efficiency remarkably lowers during the production of the toner. For this reason, a binder resin having an excessively high degree of polymerization and an excessively high softening point cannot be used.

A heat pressure fixation system utilizing a heat roller and the like is used in a wide range of applications, from low speed copying to high speed copying by virtue of very good heat efficiency, because the surface of the heat roller comes into pressure contact with the surface of the toner image of the fixation sheet. However, when the surface of the heat roller comes into contact with the surface of the toner image, the toner is deposited on the surface of the heat roller and is transferred to succeeding transfer paper, etc., that is, it tends to bring about the so-called offset phenomenon. In order to prevent the above-described phenomena, the surface of the heat roller is provided with a material having a good releasability, such as a fluororesin, and further the surface of the heat roller is coated with a releasing agent, such as silicone oil. The method wherein the surface of the heat roller is coated with a silicone oil and the like, however, brings about an increase in cost due to an increase in the size of the fixation apparatus. Furthermore, this unfavorably increases the complexity of the system and is liable to bring about a problem.

Further, as described in Japanese Patent Publication No. 493/1982 and Japanese Patent Laid-Open Nos. 44836/1975 and 37353/1982, although there is a method wherein the resin which is asymmetrized or crosslinked is used to alleviate the offset phenomenon, no improvement of the fixation temperature can be attained.

Since the lowest fixation temperature is generally between the low temperature offset disappearance temperature and the high temperature offset generation temperature, the acceptable temperature region becomes between the lowest fixation temperature and the high temperature offset generation temperature. The acceptable fixation temperature can be lowered, and the acceptable temperature region can be broadened, by making the lowest fixation temperature as low as possible and making the high temperature offset generation temperature as high as possible, which contributes to saving of energy, fixation at a high speed and prevention of curling of the paper.

For this reason, a toner always exhibiting good fixation and offset resistance has been desired in the art.

A proposal has heretofore been made on the use of a capsulated toner comprising a core material and an outer shell which covers the surface of the core material for the purpose of improving fixation at a low temperature.

When a plastic deformable low melting wax and the like is used as the core material (see U.S. Pat. No. 3,269,626, Japanese Patent Publication Nos. 15876/1971 and 9880/1969 and Japanese Patent Laid-Open Nos. 75032/1973 and 75033/1973), although fixation can be attained by the application of pressure alone, the fixation strength is so poor that this method can be used only for limited applications.

When use is made of a liquid core material, fixation can be attained by the application of pressure alone in the case where the strength of the shell material is small. In this case, however, the shell is frequently broken within the developing device, which causes the inside of the device to become stained. On the other hand, when the strength of the shell material is excessively large, a high pressure becomes necessary for breaking the capsule, which brings about the formation of an image having an excessively high gloss. This made it difficult to regulate the strength of the shell material.

For this reason, for use in heat pressure fixation, a proposal has been made on a microcapsulated toner for heat roller fixation, comprising a core material made of a resin having a low glass transition point which is capable of improving the fixation strength, although single use thereof brings about blocking at a high temperature, and an outer shell comprised of a high melting resin wall formed by interfacial polymerization for the purpose of imparting blocking resistance etc. (see Japanese Patent Laid-Open No. 56352/1986). In this toner, however, since the wall material (or the outer shell) has a high melting point, the performance of the core material cannot be sufficiently attained. Further, it was difficult to freely control the electrification of the outer shell formed by the interfacial polymerization. According to the same line of thinking, a proposal has been made on a capsulated toner for heat roller fixation which is improved in the fixation strength of the core material (Japanese Patent Laid-Open Nos. 128357/1988, 128358/1988, 128359/1988, 128360/1988, 128361/1988 and 128362/1988). Since, however, these toners are produced by spray drying, a burden is imposed on the production facilities. Furthermore, since no device or contrivance is conducted concerning the outer shell, the performance of the core material cannot be sufficiently attained.

SUMMARY OF THE INVENTION

The present invention has been made in view the above-described constraints, and thus an object of the present invention is to provide a capsulated toner for heat pressure fixation which enables the electrification property to be regulated from the inside of the capsulated toner; to provide a capsulated toner which has a lowered dependence upon the environment for the amount of the electrification which exhibits an excellent offset resistance in the heat pressure fixation system by means of a heat roller etc., and which further enables the fixation to be conducted at a low temperature; and to provide a capsulated toner which is excellent in blocking resistance and enables the formation of a clear image free from fogging, which can be stably formed over a plurality of uses.

The present inventors have made intensive and extensive studies with a view to solving the above-described problems, which have led to the completion of the present invention.

Specifically, the present invention relates to a capsulated toner for heat pressure fixation comprising a heat-meltable core material and an outer shell, said core material containing a colorant and a thermoplastic resin as a major constituent, produced by copolymerizing 0.05 to 20% by weight, based on the entire $\alpha,\beta$-ethylenically copolymerizable monomer, of (A) an $\alpha,\beta$-ethylenically copolymerizable monomer having an amino group and 99.95 to 80% by weight, based on the entire $\alpha,\beta$-ethylenically copolymerizable monomer, of (B) an $\alpha,\beta$-ethylenically copolymerizable monomer other than (A), said outer shell being provided to cover the surface of the core material.

The amino group of component (A) is preferably a tertiary amino group.

In the present invention, the outer shell is mainly composed of a resin produced by reacting (1) a monoisocyanate compound and/or an monoisothiocyanate compound in an amount of 0 to 30% by mole based on the whole of the isocyanate compound and the isothiocyanate compound, (2) a di- or higher isocyanate compound and/or a di- or higher isothiocyanate compound in an amount of 100 to 70% by mole based on the whole of the isocyanate compound and the isothiocyanate compound, (3) 0 to 30% by mole, based on the whole compound having active hydrogen reactive with an isocyanate group and/or an isothiocyanate group, of a compound having one active hydrogen reactive with an isocyanate group and/or an isothiocyanate group, and (4) 100 to 70% by mole, based on the whole compound having active hydrogen reactive with an isocyanate group and/or an isothiocyanate group, of a compound having two or more active hydrogens reactive with an isocyanate group and/or an isothiocyanate group, in such a proportion that the ratio of the total number of moles of the components (1) and (2) to the total number of moles of the components (3) and (4) is in the range of from 1:1 to 1:20, and said resin has a thermally dissociable bond occupying 30% or more of the total number of bonds in which the isocyanate group and/or isothiocyanate group are involved.

In the present invention, the thermally dissociable bond is preferably a bond derived from a reaction of a phenolic hydroxyl group and/or a thiol group with an isocyanate group and/or an isothiocyanate group, and the case that the isocyanate group is an aromatic isocyanate group is more preferable. Further, in the present invention, better properties can be obtained when the thermoplastic resin has a glass transition temperature of 10° to 50° C. and/or the capsulated toner has a softening point of 80° to 150° C.

The present invention also relates to a capsulated toner for heat pressure fixation comprising a heat-meltable core material and an outer shell, said core material containing a colorant and a thermoplastic resin as a major constituent, produced by copolymerising 0.05 to 20% by weight, based on the entire $\alpha,\beta$-ethylenically copolymerizable monomer, of (A) an $\alpha,\beta$-ethylenically copolymerizable monomer having an amino group, 99.95 to 80% by weight, based on the entire $\alpha,\beta$-ethylenically copolymerizable monomer, of (B) an $\alpha,\beta$-ethylenically copolymerizable monomer other than (A) and 0.001 to 15% by weight, based on the entire $\alpha,\beta$-ethylenically copolymerizable monomer, of a crosslinking agent, said outer shell being provided to cover the surface of the core material.

The present invention further relates to a toner composition for heat pressure fixation comprising the above-described capsulated toner and a fine powder of a hydrophobic silica.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

Examples of component (A), which is an $\alpha,\beta$-ethylenically copolymerizable monomer having an amino group, among the monomers constituting the resin as the major component of the core material used in the present invention include ethylenically monocarboxylic esters or amides having a functional group represented by the general formula (A-1);

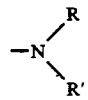

(A-1)

wherein R and R' independently stand for an alkyl group having 1 to 4 carbon atoms or an aryl group, such as dimethylaminoethyl methacrylate, diethylaminoethyl methacrylate and dimethylaminopropylmethacrylamide; pyridine compounds such as 2-vinylpyridine and 4-vinylpyridine; imidazole compounds such as 1-vinylimidazole; and other compounds such as 1-vinyl-2-pyrrolidinone, N-vinyl-2-pyrrolidone and 9-vinylcarbazole. Further, when the capsulated toner is prepared by interfacial polymerization, the amino group is preferably a tertiary amino group.

The use of the above-described monomer having an amino group (component (A)) has made it possible to regulate the amount of electrification from the inside of the capsulated toner. In the resin constituting the core material, when the amount of the component (A) is less than 0.05% by weight based on the whole, (component (A)+component (B)), no effect of regulating the electrification can be attained. On the other hand, when the amount exceeds 20% by weight, the degree of polymerization becomes unfavorably unstable, particularly when the capsulated toner is prepared by interfacial polymerization.

Further, the regulation of the electrification from inside of the capsulate toner has made it possible to decrease the percentage reduction in the amount of electrification when the environmental condition is changed from an ordinary environment to a high temperature, high humidity environment.

Examples of the component (B), which is an $\alpha,\beta$-ethylenically copolymerizable monomer not having an amino group and constituting the core material include styrene or styrene derivatives such as o-methylstyrene, m-methylstyrene, p-methylstyrene, $\alpha$-methylstyrene, p-ethylstyrene, 2,4-dimethylstyrene, p-chlorostyrene and vinylnaphthalene, ethylenically unsaturated monoolefins such as ethylene, propylene, butylene and isobutylene, vinyl compounds such as vinyl chloride, vinyl bromide, vinyl fluoride, vinyl acetate, vinyl propionate, vinyl formate and vinyl caproate, ethylenically monocarboxylic acids and their esters such as acrylic acid, methyl acrylate, ethyl acrylate, n-propyl acrylate, isopropyl acrylate, n-butyl acrylate, isobutyl acrylate, tert-butyl acrylate, amyl acrylate, cyclohexyl acrylate, n-octyl acrylate, isooctyl acrylate, decyl acrylate, lauryl acrylate, 2-ethylhexyl acrylate, stearyl acrylate, methoxyethyl acrylate, 2-hydroxyethyl acrylate, glycidyl acrylate, 2-chloroethyl acrylate, phenyl acrylate, methyl $\alpha$-chloroacrylate, methacrylic acid, methyl methacrylate, ethyl methacrylate, n-propyl methacrylate, isopropyl methacrylate, n-butyl methacrylate, isobutyl methacrylate, tert-butyl methacrylate, amyl methacrylate, cyclohexyl methacrylate, n-octyl methacrylate, isooctyl methacrylate, decyl methacrylate, lauryl methacrylate, 2-ethylhexyl methacrylate, stearyl methacrylate, methoxyethyl methacrylate, 2-hydroxyethyl methacrylate, glycidyl methacrylate and phenyl methacrylate, substituted ethylenically monocarboxylic acids such as acrylonitrile, methacrylonitrile and acrylamide, ethylenically dicarboxylic acids and substituted ethylenically dicarboxylic acids such as dimethyl maleate, vinyl ketones such as vinyl methyl ketone, vinyl ethers such as vinyl ethyl ether, and vinylidene halides such as vinylidene chloride.

As component (B), a styrene or a styrene derivative is preferably used for the formation of the main skeleton of the resin, and an ethylenically monocarboxylic acid or its ester is preferably used for the regulating heat characteristics, such as the softening temperature, of the resin.

As the resin for the core material according to the present invention, the copolymer produced by reacting component (A), component (B) and a crosslinking agent is also usable. Examples of the crosslinking agent include divinylbenzene, divinylnaphthalene, polyethylene glycol dimethacrylate, diethylene glycol diacrylate, triethylene glycol diacrylate, 1,3-butylene glycol dimethacrylate, 1,6-hexylene glycol dimethacrylate, neopentyl glycol dimethacrylate, dipropylene glycol dimethacrylate, polypropylene glycol dimethacrylate, 2,2'-bis(4-methacryloxydiethoxyphenyl)propane, 2,2'-bis(4-acryloxydiethoxyphenyl)propane, trimethylolpropane trimethacrylate, trimethylolpropane triacrylate, tetramethylolmethane tetraacrylate, bromoneopentyl glycol dimethacrylate and diallyl phthalate. If necessary, a plurality of crosslinking agents in combination may be used.

In the case that a crosslinking agent(s) is used, when the amount of the crosslinking agent(s) is excessively large, it becomes so difficult to melt the toner by heat that the heat fixation or heat pressure fixation is deteriorated. On the other hand, when the amount is excessively small, it becomes difficult to prevent the offset phenomenon wherein during the heat pressure fixation, part of the toner does not completely fix on paper, deposits on the surface of the roller and transfers to the next paper. Further, the amount of use of the above-described crosslinking agent(s) is preferably 0.001 to 15% by weight (more preferably 0.1 to 10% by weight) based on the entire $\alpha,\beta$-ethylenically copolymerizable monomer, that is, component (A)+component (B).

The above-described monomer (component (A) and component (B)) may be polymerized in the presence of an unsaturated polyester to prepare a graft or crosslinked polymer which may be used as a resin for the core material.

In the production of the thermoplastic resin for the core material, use is made of a polymerization initiator, and examples thereof include azo or diazo polymerization initiators such as 2,2'-azobis(2,4-dimethylvaleronitrile), 2,2'-azobis(isobutyronitrile), 1,1'-azobis(cyclohexane-1-carbonitrile) and 2,2'-azobis(4-methoxy-2,4-dimethylvaleronitrile); and peroxide polymerization initiators such as benzoyl peroxide, methyl ethyl ketone peroxide, isopropyl peroxycarbonate, cumene hydroperoxide, 2,4-dichlorobenzoyl peroxide, lauroyl peroxide and dicumyl peroxide.

It is also possible to use a mixture of two or more polymerization initiators for the purpose of regulating the molecular weight or molecular weight distribution of the polymer, or regulating the reaction time. The amount of the polymerization initiator is 0.1 to 20 parts by weight, preferably 1 to 10 parts by weight based on 100 parts by weight of the entire $\alpha,\beta$-ethylenically copolymerizable monomer, that is, component (A)+component (B).

If necessary, at least one offset preventive agent selected from, for example, a polyolefin, a metal salt of fatty acid, a fatty acid ester, a partially saponified fatty acid ester, a higher fatty acid, a higher alcohol, a paraffin wax, an amide wax, a polyhydric alcohol ester, a silicone varnish, an aliphatic fluorocarbon and an silicone oil may be incorporated in the core material for the purpose of improving the offset resistance in the heat pressure fixation.

Examples of the polyolefin include resins, such as polypropylene, polyethylene and polybutene, which have a softening point of 80° to 160° C. Examples of the metal salt of a fatty acid include zinc, magnesium, calcium or other metal salts of maleic acid; zinc, cadmium, barium, lead, iron, nickel, cobalt, copper, aluminum, magnesium or other metal salts of stearic acid; dibasic lead stearate; zinc, magnesium, iron, cobalt, copper, lead, calcium or other metal salts of oleic acid; aluminum, calcium or other metal salts of palmitic acid; a salt of caprylic acid; lead caproate; zinc, cobalt or other metal salts of linolic acid; calcium ricinoleate; zinc, cadmium or other metal salts of ricinolic acid; and mixtures thereof. Examples of the fatty acid ester include ethyl maleate, butyl maleate, methyl stearate, butyl stearate, cetyl palmitate and ethylene glycol ester of montanic acid. Examples of the partially saponified fatty acid ester include a montanic acid ester partially saponified with calcium. Examples of the higher fatty acid include dodecanoic acid, lauric acid, myristic acid, palmitic acid, stearic acid, oleic acid, linolic acid, ricinolic acid, arachic acid, behenic acid, lignoceric acid, selacholeic acid and mixtures thereof. Examples of the higher alcohol include dodecyl alcohol, lauryl alcohol, myristyl alcohol, palmityl alcohol, stearyl alcohol, arachyl alcohol and behenyl alcohol. Examples of the paraffin wax include natural wax, microwax, a synthetic paraffin and a chlorinated hydrocarbon. Examples of the amide wax include stearic acid amide, oleic acid amide, palmitic acid amide, lauric acid amide, behenic acid amide, methylenebisstearamide, ethylenebisstearamide, N,N'-m-xylylenebis(stearic acid amide), N,N'-m-xylylenebis(12-hydroxystearic acid amide), N,N'-isophthalic acid bisstearylamide and N,N'-isophthalic acid-bis(12-hydroxystearylamide). Examples of the polyhydric alcohol ester include glycerin stearate, glycerin ricinoleate, glycerin monobehenate, sorbitan monostearate, propylene glycol monostearate and sorbitan trioleate. Examples of the silicone varnish include methyl silicone varnish and phenyl silicone varnish. Examples of the aliphatic fluorocarbon include a lower polymer of ethylene tetrafluoride or propylene hexafluoride and a fluorosurfactant described in Japanese Patent Laid-Open No. 124428/1978.

In the production of a capsulated toner, when the outer shell is formed by interfacial polymerization or in-situ polymerization, the use of a large amount of a compound having a functional group reactive with an isocyanate group, such as the higher fatty acid and the higher alcohol, in the core material is undesirable due to the inhibition of the formation of the outer shell and deterioration in the storage stability of the capsulated toner.

The content of the above-described offset preventive agent is preferably 1 to 20% by weight based on the resin in the core material.

In the present invention, a colorant is contained in the core material of the capsulated toner, and any of the dyes, pigments and other colorants used as the conventional toner colorant may be used.

Examples of the colorant used in the present invention include various types of carbon black produced by a thermal black method, an acetylene black method, a channel black method, a lamp black method, etc., a grafted carbon black comprising a carbon black having a surface coated with a resin, a nigrosine dye, phthalocyanine blue, permanent brown FG, brilliant fast scarlet, pigment green B, rhodamine B base, solvent red 49, solvent red 146, solvent blue 35 and mixtures thereof. The amount of the colorant is usually about 1 to 15 parts by weight based on 100 parts by weight of the resin in the core material.

When the formation of a magnetic capsulated toner is intended, a magnetic particle may be added to the core material. Examples of the magnetic particle include metals having a ferromagnetism, such as iron, cobalt and nickel or alloys thereof, such as ferrite and magnetite, or compounds containing these elements, or alloys not containing any ferromagnetic element but capable of exhibiting a ferromagnetism upon being subjected to a suitable heat treatment, such as, for example, alloys called "heusler alloys" and including manganese and copper, such as manganese-copper-aluminum, manganese-copper-tin, and chromium dioxide. The above-described magnetic substance is homogeneously dispersed in the form of a fine powder having a mean particle diameter of 0.1 to 1 μm in the core material. The content of the magnetic substance is 20 to 70 parts by weight, preferably 30 to 70 parts by weight based on 100 parts by weight of the capsulated toner.

In order to prepare a magnetic toner, the powder of a magnetic substance may be incorporated by the same treatment as that used in the case of the colorant. The powder of a magnetic substance, as such, however, has a low affinity for organic substances such as the raw material used for the core material including the monomers. In this case, when the powder of a magnetic substance is used in combination with the so-called "coupling agent", such as a titanium coupling agent, a silane coupling agent and lecithin, or after treatment with the coupling agent, it can be homogeneously dispersed.

Furthermore, a silicone oil as a flow improver and a metal salt of a higher fatty acid as a cleaning improver may be added in the core material.

In the present invention, the outer shell of the capsulated toner for heat pressure fixation is preferably composed of a resin which is produced by reacting (1) a monoisocyanate compound and/or an monoisothiocyanate compound in an amount of 0 to 30% by mole based on the whole of the isocyanate compound and the isothiocyanate compound, (2) a di- or higher isocyanate compound and/or a di- or higher isothiocyanate compound in an amount of 100 to 70% by mole based on the whole of the isocyanate compound and the isothiocyanate compound, (3) 0 to 30% by mole, based on the whole compound having active hydrogen reactive with an isocyanate group and/or an isothiocyanate group, of a compound having one active hydrogen reactive with an isocyanate group and/or an isothiocyanate group, and (4) 100 to 70% by mole, based on the whole compound having active hydrogen reactive with an isocyanate group and/or an isothiocyanate group, of a compound having two or more active hydrogens reactive with an isocyanate group and/or an isothiocyanate group, in such a proportion that the ratio of the total number of moles of the components (1) and (2) to the total number of moles of the components (3) and (4) is in the range of from 1:1 to 1:20, and which has a thermally dissociable bond occupying 30% and more of the total number of bonds in which the isocyanate group and/or isothiocyanate group are involved.

The thermally dissociable bond includes, for example, amide bond, urethane bond, urea bond, thioamide bond, thiourethane bond and thiourea bond, and is formed by the reaction of an isocyanate group and/or an isothiocyanate group with an active hydrogen. When heating is conducted, the thermally dissociable bond dissociates into an isocyanate group and/or an isothiocyanate group, and a hydroxyl group, though the bond is in a dissociative equilibrium state below a thermally dissociable temperature.

In the present invention, the thermally dissociable bond is preferably bond derived from a reaction of a phenolic hydroxyl group and/or a thiol group with an isocyanate group and/or an isothiocyanate group. For example, a thermally dissociable urethane bond is a bond wherein the urethane bond dissociates into an isocyanate group and a hydroxyl group at a certain temperature. This is known also as a blocked isocyanate and well known in the field of paints.

Blocking of polyisocyanates is conducted in the presence of a blocking agent, and is known as a method of temporarily preventing the reaction of an isocyanate group with an active hydrogen. Documents such as Z. W. Wicks Jr., Prog. in Org. Coatings, vol. 3, 73 (1975) describe various blocking agents, for example, tertiary alcohols, phenols, acetoacetic acid esters and ethyl malonate.

In the thermally dissociable polyurethane favorably used as a thermoplastic resin in the present invention, it is important to have a low thermally dissociable temperature. As can be seen also from the results described in documents such as G. R. Grittin and L. J. Willwerth, Ind. Eng. Chem. Prod. Res. Develop., vol. 1, 265 (1962), among resins having urethane bonds, a resin having a urethane bond formed by a reaction of an isocyanate compound with a phenolic hydroxyl group has a low thermally dissociable temperature and is preferably used.

The thermal dissociation is an equilibrium reaction and expressed, for example, by the following formula. It is known that the reaction proceeds from the right side to the left side of the formula.

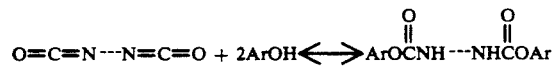

wherein Ar stands for an aromatic group.

Examples of the monoisocyanate compound (1) used in the present invention include monoisocyanate compounds such as ethyl isocyanate, octyl isocyanate, 2-chloroethyl isocyanate, chlorosulfonyl isocyanate, cyclohexyl isocyanate, n-dodecyl isocyanate, butyl isocyanate, n-hexyl isocyanate, lauryl isocyanate, phenyl isocyanate, m-chlorophenyl isocyanate, 4-chlorophenyl isocyanate, p-cyanophenyl isocyanate, 3,4-dichlorophenyl isocyanate, o-tolyl isocyanate, m-tolyl isocyanate, p-tolyl isocyanate, p-toluenesulfonyl isocyanate, 1-naphthyl isocyanate, o-nitrophenyl isocyanate, m-nitrophenyl isocyanate, p-nitrophenyl isocyanate, phenyl isocyanate, p-bromophenyl isocyanate, o-methoxyphenyl isocyanate, m-methoxyphenyl isocyanate, p-methoxyphenyl isocyanate, ethyl isocyanatoacetate, butyl isocyanatoacetate and trichloroacetyl isocyanate.

Examples of the diisocyanate compound (2) used in the present invention include aromatic isocyanate compounds such as 2,4-tolylene diisocyanate, a dimer of 2,4-tolylene diisocyanate, 2,6-tolylene diisocyanate, p-xylylene diisocyanate, m-xylylene diisocyanate, 4,4'-diphenylmethane diisocyanate, 1,5-naphthylene diisocyanate, 3,3'-dimethyldiphenyl-4,4'-diisocyanate, 3,3'-dimethyldiphenylmethane-4,4'-diisocyanate, m-phenylene diisocyanate, triphenylmethane-triisocyanate and polymethylenephenyl isocyanate, aliphatic isocyanate compounds such as hexamethylene diisocyanate, trimethylhexamethylene diisocyanate, lysine diisocyanate, dimer acid diisocyanate, alicyclic isocyanate compounds such as isophorone diisocyanate, 4,4'-methylenebis(cyclohexylisocyanate), methylcyclohexane-2,4-(or 2,6-)diisocyanate and 1,3-(isocyanatemethyl)cyclohexane, and isocyanate compounds such as an adduct of 3 moles of tolylene diisocyanate with one mole of trimetylolpropane.

Among them, a compound wherein an isocyanate group is directly bonded to an aromatic ring is useful and preferred for lowering the thermally dissociable temperature after the formation of an urethane bond.

Examples of the compound having an isothiocyanate group include compounds such as phenyl isothiocyanate, xylylene-1,4-diisothiocyanate and ethylidyne diisothiocyanate.

In the present invention, the monoisocyanate compound and/or monoisothiocyanate compound (1) may be used in an amount up to 30% by mole based on the whole of the isocyanate compound and the isothiocyanate compound also for the purpose of regulating the molecular weight of the outer shell resin. When the amount of use exceeds 30% by mole, the storage stability of the capsulated toner unfavorably deteriorates.

In the present invention, examples of the compound having one active hydrogen reactive with an isocyanate group and/or an isothiocyanate group (3) include aliphatic alcohols such as methyl alcohol, ethyl alcohol, n-propyl alcohol, isopropyl alcohol, n-butyl alcohol, isobutyl alcohol, tert-butyl alcohol, pentyl alcohol, hexyl alcohol, cyclohexyl alcohol, heptyl alcohol, octyl alcohol, nonyl alcohol, decyl alcohol, lauryl alcohol and stearyl alcohol, aromatic alcohols such as phenol, o-cresol, m-cresol, p-cresol, 4-n-butyl phenol, 2-sec-butyl phenol, 2-tert-butyl phenol, 3-tert-butyl phenol, 4-tert-butyl phenol, nonyl phenol, isononyl phenol, 2-propenyl phenol, 3-propenyl phenol, 4-propenyl phenol, 2-methoxy phenol, 3-methoxy phenol, 4-methoxy phenol, 3-acetyl phenol, 3-carbomethoxy phenol, 2-chlorophenol, 3-chlorophenol, 4-chlorophenol, 2-bromophenol, 3-bromophenol, 4-bromophenol, benzyl alcohol, 1-naphthol, 2-naphthol and 2-acetyl-1-naphthol and amides such as ε-caprolactum.

Among them, phenol derivatives represented by the following formula (I) are preferably used.

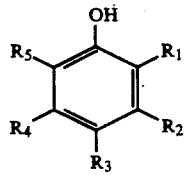

(I)

wherein $R_1$, $R_2$, $R_3$, $R_4$ and $R_5$ each independently stand for hydrogen atom, an alkyl group having 1 to 9 carbon atoms, an alkenyl group having 1 to 9 carbon atoms, an alkoxy group having 1 to 9 carbon atoms, an alkanoyl group having 1 to 9 carbon atoms, a carboalkoxy group having 2 to 9 carbon atoms, an aryl group having 6 to 9 carbon atoms or a halogen atom.

Examples of dihydric or higher alcohol compound among the compound having two or more active hydrogens reactive with an isocyanate group and/or an isothiocyanate group (4) used in the present invention include catechol, resorcin, hydroquinone, 4-methylcatechol, 4-tert-butylcatechol, 4-acetylcatechol, 3-methoxycatechol, 4-phenylcatechol, 4-methylresorcin, 4-ethylresorcin, 4-tert-butyl-resorcin, 4-hexylresorcin, 4-chlororesorcin, 4-benzylresorcin, 4-acetylresorcin, 4-carbomethoxyresorcin, 2-methylresorcin, 5-methylresorcin, tert-butylhydroquinone, 2,5-di-tert-butylhydroquinone, 2,5-di-tert-amylhydroquinone, tetramethylhydroquinone, tetrachlorohydroquinone, methylcarboaminohydroquinone, methylureidohydroquinone, benzonorbornene-3,6-diol, bisphenol A, bisphenol S, 3,3'-dichlorobisphenol S, 2,2'-dihydroxybenzophenone, 2,4-dihydroxybenzophenone, 4,4'-dihydroxybenzophenone, 2,2'-dihydroxydiphenyl, 4,4'-dihydroxydiphenyl, 2,2'-dihydroxydiphenylmethane, 3,4-bis(p-hydroxyphenyl)hexane, 1,4-bis(2-(p-hydroxyphenyl)propyl)benzene, bis(4-hydroxyphenyl)methylamine, 1,3-dihydroxynaphthalene, 1,4-dihydroxynaphthalene, 1,5-dihydroxynaphthalene, 2,6-dihydroxynaphthalene, 1,5-dihydroxyanthraquinone, 2-hydroxybenzyl alcohol, 4-hydroxybenzyl alcohol, 2-hydroxy-3,5-di-tert-butylbenzyl alcohol, 4-hydroxy-3,5-di-tert-butylbenzyl alcohol, 4-hyroxyphenetyl alcohol, 2-hydroxyethyl-4-hydroxybenzoate, 2-hydroxyethyl-4-hydroxyphenyl acetate, resorcin mono-2-hydroxyethyl ether, hydroxyhydroquinone, gallic acid and ethyl 3,4,5-trihydroxybenzoate. Among them, catechol derivatives represented by the following formula (II) or resorcin derivatives represented by the following formula (III) are preferably used.

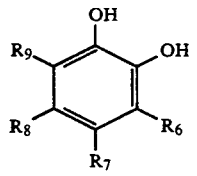

(II)

wherein $R_6$, $R_7$, $R_8$ and $R_9$ each independently stand for hydrogen atom, an alkyl group having 1 to 6 carbon atoms, an alkenyl group having 1 to 6 carbon atoms, an alkoxy group having 1 to 6 carbon atoms, an alkanoyl group having 1 to 6 carbon atoms, a carboalkoxy group having 2 to 6 carbon atoms, an aryl group having 6 carbon atoms or a halogen atom; and

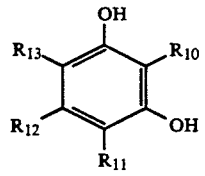

(III)

wherein $R_{10}$, $R_{11}$, $R_{12}$ and $R_{13}$ each independently stand for hydrogen atom, an alkyl group having 1 to 6 carbon atoms, an alkenyl group having 1 to 6 carbon atoms, an alkoxy group having 1 to 6 carbon atoms, an alkanoyl group having 1 to 6 carbon atoms, a carboalkoxy group having 2 to 6 carbon atoms, an aryl group having 6 carbon atoms or a halogen atom.

Examples of a compound having at least one functional group except a hydroxyl group capable of reacting with an isocyanate group and/or an isocyanate group and at least one phenolic hydroxyl group include o-hydroxybenzoic acid, m-hydroxybenzoic acid, p-hydroxybenzoic acid, 5-bromo-2-hydroxybenzoic acid, 3-chloro-4-hydroxybenzoic acid, 4-chloro-2-hydroxybenzoic acid, 5-chloro-2-hydroxybenzoic acid, 3,5-dichloro-4-hydroxybenzoic acid, 3-methyl-2-hydroxybenzoic acid, 5-methoxy-2-hydroxybenzoic acid, 3,5-ditert-butyl-4-hydroxybenzoic acid, 4-amino-2-hydroxybenzoic acid, 5-amino-2-hydroxybenzoic acid, 2,5-dinitrosalicylic acid, sulfosalicylic acid, 4-hydroxy-3-methoxyphenylacetic acid, catechol-4-carboxylic acid, 2,4-dihydroxybenzoic acid, 2,5-dihydroxybenzoic acid, 2,6-dihydroxybenzoic acid, 3,4-dihydroxybenzoic acid, 3,5-dihydroxybenzoic acid, 3,4-dihydroxyphenylacetic acid, m-hydroxycinnamic acid, p-hydroxycinnamic acid, 2-amino-4-methylphenol, 2-amino-5-methylphenol, 5-amino-2-methylphenol, 3-amino-2-naphthol, 8-amino-2-naphthol, 1-amino-2-naphthol-4-sulfonic acid, 2-amino-5-naphthol-4-sulfonic acid, 2-amino-4-nitrophenol, 4-amino-2-nitrophenol, 4-amino-2,6-dichlorophenol, o-aminophenol, m-aminophenol, p-aminophenol, 4-chloro-2-aminophenol, 1-amino-4-hydroxyanthraquinone, 5-chloro-2-hydroxyaniline, α-cyano-3-hydroxycinnamic acid, α-cyano-4-hydroxycinnamic acid, 1-hydroxynaphthoic acid, 2-hydroxynaphthoic acid, 3-hydroxynaphthoic acid and 4-hydroxyphthalic acid.

Examples of the thiol compound having at least one thiol group in its molecule include ethanethiol, 1-propanethiol, 2-propanethiol, thiophenol, bis(2-methylcaptoethyl)ether, 1,2-ethanedithiol, 1,4-butanedithiol, bis(2-mercaptoethyl)sulfide, ethylene glycolbis(2-mercaptoacetate), ethylene glycolbis(3-mercaptopropionate), 2,2-dimethylpropanediolbis(2-mercaptoacetate), 2,2-dimethylpropanediolbis(3-mercaptopropionate), trimethylolpropanetris(2-mercaptoacetate), trimethylolpropanetris(3-mercaptopropionate), trimethylolethanetris(2-mercaptoacetate), trimethylolethanetris(3-mercaptopropionate), pentaerythritoltetrakis(2-mercaptoacetate), pentaerythritoltetrakis(3-mercaptopropionate), dipentaerythritolhexakis(2-mercaptoacetate), dipentaerythritolhexakis(3-mercaptopropionate), 1,2-dimercaptobenzene, 4-methyl-1,2-dimercaptobenzene, 3,6-dichloro-1,2-dimercaptobenzene, 3,4,5,6-tetrachloro-1,2-dimercaptobenzene, xylylenedithiol and 1,3,5-tris(3-mercaptopropyl)isocyanurate.

In the thermally dissociable outer shell resin used in the present invention, the number of thermally dissociable bonds occupies 30% and more, preferably 50% and more, of the total number of bonds in which the isocyanate group and/or isothiocyanate group are involved. When the number of thermally dissociable bonds is less than 30% based on the total number of bonds in which the isocyanate group and/or isothiocyanate group are involved, no sufficient lowering in the strength of the outer shell of the capsule can be obtained during heat pressure fixation, so that no desired fixation performance of the core material can be attained.

In the present invention, it is possible to use, as an outer shell forming substance, compounds having a functional group reactive with an isocyanate group other than the phenolic hydroxyl group and thiol group, for example, compounds having an active methylene group such as the following malonic esters and acetoacetic esters, oximes such as methyl ethyl ketone oxime, carboxylic acids, polyols, polyamines, aminocarboxylic acids, aminoalcohols, etc. in such an amount that the number of thermally dissociable bonds, which are derived from a reaction of a phenolic hydroxyl group and/or a thiol group with an isocyanate group and/or an isothiocyanate group, does not become less than 30% based on the total number of bonds in which the isocyanate group and/or isothiocyanate group are involved.

Examples of the above-described compound having an active methylene group include compounds having an active methylene group such as malonic acid, monomethyl malonate, monoethyl malonate, isopropyl malonate, dimethyl malonate, diethyl malonate, diisopropyl malonate, tert-butylethyl malonate, malondiamide, acetylacetone, methyl acetoacetate, ethyl acetoacetate, tert-butyl acetoacetate and allyl acetoacetate.

Examples of the above-described carboxylic acid include monocarboxylic acids such as acetic acid, propionic acid, n-butyric acid, isobutyric acid, pentanoic acid, hexanoic acid and benzoic acid, dicarboxylic acids such as maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid and n-octylsuccinic acid, tri- or higher carboxylic acids such as 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid and trimer acid of empole.

Examples of the polyol include diols such as ethylene glycol, propylene glycol, butylene glycol, neopentyl glycol, hexamethylene glycol, diethylene glycol and dipropylene glycol; triols such as glycerin, trimethylolpropane, trimethylolethane and 1,2,6-hexanetriol; pentaerythritol and water. Examples of the polyamine include ethylenediamine, hexamethylenediamine, diethylenetriamine, iminobispropylamine, phenylenediamine, xylylenediamine and triethylenetetramine.

In the present invention, the compound having one active hydrogen capable of reacting with an isocyanate group and/or an isothiocyanate group (3) is used in an amount up to 30% by mole based on the whole compound capable of reacting with an isocyanate compound and/or an isothiocyanate compound. When the amount of this compound exceeds 30% by mole, the storage stability of the capsulated toner undesirably deteriorates.

The molar ratio of the isocyanate compound and/or isothiocyanate compound [(1)+(2)] to the compounds reactive with the isocyanate group and/or isothiocyanate group [(3)+(4)] is preferably in the range of from 1:1 to 1:20.

In the production of the capsulated toner, the formation of the outer shell is preferably conducted by interfacial polymerization or in-situ polymerization. However, it is also possible to form the outer shell by a dry method wherein a major particle as the core material and a minor particle as an outer shell forming raw material having a number average particle diameter of $\frac{1}{8}$ or less of that of the major particle are stirred at a high speed in a gas stream.

The outer shell resin can be produced in the absence of a catalyst. When the production is conducted in the presence of a catalyst, it is possible to use tin catalysts such as dibutyltin dilaurate, amine catalysts such as 1,4-diazabicyclo-[2.2.2]octane and N,N,N-tris(dimethylaminopropyl)hexahydro-S-triazine and known urethane catalysts.

When the capsulated toner is produced by interfacial polymerization or in-situ polymerization, the material constituting the outer shell (or the monomer etc. which become the outer shell by polymerization) and the material constituting the core material (or the monomer etc. which become the core material by polymerization) are dispersed in the dispersion medium. In this connection, it is necessary to incorporate a dispersion stabilizer in a dispersion medium for the purpose of preventing the agglomeration and coalescence of the dispersoid.

Examples of the dispersion stabilizer include gelatin, gelatin derivatives, polyvinyl alcohol, polystyrenesulfonic acid, hydroxymethyl cellulose, hydroxyethyl cellulose, hydroxypropyl cellulose, sodium carboxymethyl cellulose, sodium polyacrylate, sodium dodecylbenzenesulfonate, sodium tetradecylsulfate, sodium pentadecylsulfate, sodium octylsulfate, sodium allyl-alkylpolyethersulfonate, sodium oleate, sodium laurate, sodium caprate, sodium caprylate, sodium caproate, potassium stearate, calcium oleate, sodium 3,3-disulfonediphenylurea-4,4-diazo-bis-amino-$\beta$-naphthol-6-sulfonate, o-carboxybenzene-azo-dimethylaniline, sodium 2,2,5,5-tetramethyl-triphenylmethane-4,4-diazo-bis-$\beta$-naphtholdisulfonate, colloidal silica, alumina, tricalcium phosphate, ferric hydroxide, titanium hydroxide and aluminum hydroxide. It is also possible to use the above-described dispersion stabilizers in a combination of two or more.

Examples of the dispersion medium for the dispersion stabilizer and dispersoids include water, methanol, ethanol, propanol, butanol, ethylene glycol, glycerin, acetonitrile, acetone, isopropyl ether, tetrahydrofuran and dioxane. They may be used alone or in the form of a mixture of two or more.

In the outer shell material of the capsulated toner according to the present invention, a suitable amount of a metal-containing dye, such as a metal complex of an organic compound having a carboxyl group or a nitrogen group, and nigrosine commonly used in the art for a toner may be added as a charge control agent. The charge control agent may be used in the form of a mixture with a toner.

According to the present invention, the glass transition point of the thermoplastic resin as a major component of the heat-meltable core material is preferably 10° to 50° C. When the glass transition point is less than 10° C., the storage stability of the capsulated toner deteriorates, while when the glass transition point exceeds 50° C., the fixation strength of the capsulated toner unfavorably deteriorates. In the present invention, the term "glass transition temperature" is intended to mean a temperature at an intersection of a line extended from the base line of a curve at a portion below the glass transition temperature and a tangential line having the maximum gradient between the rising portion of the peak and the vertex of the peak determined through the use of a differential scanning calorimeter (manufactured by Seiko Instruments Inc.) at a temperature rise rate of 10° C./min.

In the present invention, the softening point of the capsulated toner is preferably 80° to 150° C. When the softening point is below 80° C., the offset resistance deteriorates, while when the softening point exceeds 150° C., the fixation strength unfavorably deteriorates. In the present invention, the term "softening point" is intended to mean a temperature determined as follows. A sample having a volume of 1 $cm^3$ is extruded through a nozzle having a diameter of 1 mm and a length of 1 mm while heating the sample at a temperature rise rate of 6° C./min under application of a load of 20 $kg/cm^2$ by means of a plunger through the use of a Koka flow tester (manufactured by Shimadzu Corporation) to obtain an S-shaped curve of the depression of plunger plotted against the temperature of the flow tester, and the temperature corresponding to h/2 wherein h is a height of the S-shaped curve is determined as the softening point.

In the present invention, although there is no particular limitation on the particle diameter of the capsulated toner, the average particle diameter is usually 3 to 30 μm. The thickness of the outer shell of the capsulated toner is preferably 0.01 to 1 μm. When the thickness of the outer shell of the capsulated toner is less than 0.01 μm, the blocking resistance deteriorates, whereas when the thickness exceeds 1 μm, the heat meltability unfavorably deteriorates.

The capsulated toner of the present invention may be used with a flow improver, a cleaning improver, etc., if necessary. Namely, the capsulated toner may be used as a component of a toner composition. Examples of the flow improver include silica, alumina, titanium oxide, barium titanate, magnesium titanate, calcium titanate, strontium titanate, zinc oxide, quartz sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide and silicon nitride. A fine powder of silica is preferred and a fine powder of a hydrophobic silica is particularly preferred as a flow improver.

The fine powder of silica is a fine powder of a compound having a Si-O-Si bond and may be produced by any of dry and wet processes. Although the fine powder of silica may contain any of aluminum silicate, sodium silicate, potassium silicate, magnesium silicate and zinc silicate in addition to anhydrous silicon dioxide, it is preferred for them to have an $SiO_2$ content of 85% by weight and more. Further, as the fine powder of silica, it is also possible to use a fine powder of silica subjected to a surface treatment with a silane coupling agent, a titanium coupling agent, a silicone oil, a silicone oil having an amino group on its side chain and the like.

Examples of the cleaning improver include impalpable powders of a metal salt of a higher fatty acid represented by zinc stearate, and a fluoropolymer.

Further, it is also possible to use an additive for regulating developability, for example, an impalpable powder of a polymer polymerized with methyl methacrylate, butyl methacrylate and the like.

A minor amount of carbon black may be used for toning and resistance regulation purposes. Examples of the carbon black include those of various types known in the art, for example, furnace black, channel black and acetylene black.

The capsulated toner of the present invention, as such, may be used as a developing agent when it contains an impalpable powder of a magnetic substance. On the other hand, when it contains no impalpable powder of a magnetic substance, it may be mixed with a carrier to prepare a binary developing agent. There is no particular limitation on the carrier, and examples thereof include an iron powder, ferrite, glass beads, etc., and these materials can be coated with a resin. The mixing ratio of the toner is 0.5 to 10% by weight based on the carrier. The particle diameter of the carrier is in the range of from 30 to 500 μm.

The capsulated toner of the present invention can provide a good fixation strength when it is fixed on a recording material, such as paper, through the combined use of heat and pressure. As far as use is made of a combination of heat with pressure, methods including a known heat roller fixation system, a fixation system as described in Japanese Patent Laid-Open No. 190870/1990 wherein an unfixed toner image on the recording material is heat-melted by heating means comprising a heating portion and a heat resistant sheet through the heat resistant sheet to conduct the fixation, a fixation system as described in Japanese Patent Laid-Open No. 162356/1990 wherein a toner image is fixed on a recording material by heat pressure fixation through the use of a fixed, supported heating material and a pressing member, which is provided to face, and be in pressure contact with, the heating material and makes the recording material close by adhere with the heating material through a film, are suitable for the fixation of the capsulated toner of the present invention.

According to the capsulated toner for heat pressure fixation according to the present invention, since the electrification can be regulated from within the capsulated toner, the dependency of the amount of electrification upon the environment is small. Further, since the offset resistance in a heat pressure fixation system, such as a heat roller, is excellent, the fixation can be conducted at a low temperature. Further, the blocking resistance is so excellent that a clear image free from fogging can be stably formed over a plurality of uses.

The present invention will now be described in more detail with reference to the following Examples, which should be considered as merely exemplary of the present invention.

EXAMPLE 1

To a mixture of 70 parts by weight of styrene with 29.0 parts by weight of 2-ethylhexyl acrylate, 1.0 part by weight of dimethylaminoethyl methacrylate and 1.0 part by weight of divinylbenzene were added 10.0 parts by weight of carbon black "#44" (manufactured by Mitsubishi Kasei Corp.), 4.0 parts by weight of 2,2'-azobisisobutyronitrile and 9.5 parts by weight of 4,4'-diphenylmethane diisocyanate "Millionate MT" (manufactured by Nippon Polyurethane Industry Co., Ltd.). The mixture was put in an attritor (manufactured by Mitsui Miike Engineering Corp.) and dispersed at 10° C. for 5 hr to prepare a polymerizable composition. To 800 g of a 4 wt. % aqueous colloid solution of tricalcium phosphate previously prepared in a 2-liter separable flask of glass was added the polymerizable composition in such an amount that the concentration of the polymerizable composition became 30% by weight based on the total of the aqueous colloid solution and the polymerizable composition, and emulsion dispersion was conducted at 5° C. and a number of revolutions of 10000 rpm for 2 min through the use of a TK homomixer (manufactured by Tokushu Kika Kogyo Co., Ltd.). A four neck glass lid was put on the flask, and a reflux condenser, a thermometer, a dropping funnel equipped with a nitrogen inlet tube and a stainless steel stirring rod were mounted. The flask was then placed in an electric heating mantle. A mixed solution containing 22.0 g of resorcin, 3.6 g of diethyl malonate, 0.5 g of 1,4-diazabicyclo[2.2.2]octane and 40 g of deionized water was prepared and added in portions by means of the dropping funnel while stirring over a period of 30 min. Thereafter, the mixture was heated to 80° C. while continuing the stirring under nitrogen, and the reaction was allowed to proceed for 10 hr. After cooling the reaction mixture, a dispersant was dissolved through the use of a 10% aqueous hydrochloric acid solution, and the mixture was filtered. The residue was washed with water, dried at 45° C. for 12 hr under a reduced pressure of 20 mmHg, and classified by means of an air classifier to give a capsulated toner having a mean particle diameter of 9 μm wherein the outer shell comprises a resin having a thermally dissociable urethane bond. The glass transition point of the resin in the core material of the capsulated toner and the softening point of the capsulated toner were 32.5° C. and 134° C., respectively.

0.4 part by weight of a fine powder of a hydrophobic silica "Aerosil R-972" (manufactured by Aerosil co., Ltd.) was added and mixed with 100 parts by weight of this capsulated toner to prepare the toner composition according to the present invention. This toner composition was designated as toner 1.

EXAMPLE 2

The procedure of Example 1 was repeated up to the surface treatment, except that 29.5 parts by weight of 2-ethylhexyl acrylate and 0.5 part by weight of dimethylaminoethyl methacrylate were used instead of 29.0 parts by weight of 2-ethylhexyl acrylate and 1.0 part by weight of dimethylaminoethyl methacrylate, thereby preparing a toner composition containing a capsulated toner. This toner composition was designated as toner 2. The glass transition point of the resin in the core material of the capsulated toner and the softening point of the capsulated toner were 31.0° C. and 133.0° C., respectively.

EXAMPLE 3

To a mixture of 50 parts by weight of styrene with 34 parts by weight of 2-ethylhexyl acrylate, 1 part by weight of dimethylaminopropyl methacrylamide and 1.0 part by weight of divinylbenzene were added 40 parts by weight of carbon black grafted with styrene "GP-E-3" (manufactured by Ryoyu Kogyo K.K.), which contains 40% by weight of styrene monomer, 30% by weight of polystyrene and 30% by weight of grafted carbon black, 5.0 parts by weight of lauroyl peroxide, 9.0 parts by weight of tolylene diisocyanate "Coronate T-100" (manufactured by Nippon Polyurethane Industry Co., Ltd.) and 0.5 part by weight of phenyl isocyanate, thereby preparing a polymerizable composition.

To 800 g of a 4 wt. % aqueous colloid solution of tricalcium phosphate previously prepared in a 2-liter separable flask of glass was added the polymerizable composition in such an amount that the concentration of the polymerizable composition was 30% by weight based on the total of the aqueous colloid solution and the polymerizable composition, and emulsion dispersion was conducted at 5° C. and a number of revolutions of 10000 rpm for 2 min through the use of a TK homomixer (manufactured by Tokushu Kika Kogyo Co., Ltd.). A four neck glass lid was put on the flask, and a reflux condenser, a thermometer, a dropping funnel equipped with a nitrogen inlet tube and a stainless steel stirring rod were mounted. The flask was then placed in an electric heating mantle. A mixed solution comprising 22.0 g of resorcin, 3.0 g of m-aminophenol, 2.2 g of tert-butyl alcohol, 0.5 g of 1,4-diazabicyclo[2.2.2]octane and 40 g of deionized water was prepared and added in portions by means of the dropping funnel while stirring over a period of 30 min. Thereafter, the mixture was heated to 80° C. while continuing the stirring under nitrogen, and the reaction was allowed to proceed for 10 hr. After cooling the reaction mixture, a dispersant was dissolved through the use of a 10% aqueous hydrochloric acid solution, and the mixture was filtered. The residue was washed with water, dried at 45° C. for 12 hr under a reduced pressure of 20 mmHg, and classified by means of an air classifier to give a capsulated toner having a mean particle diameter of 9 μm wherein the outer shell comprises a resin having a thermally dissociable urethane bond. The glass transition point of the resin in the core material of the capsulated toner and the softening point of the capsulated toner were 35.0° C. and 132.5° C., respectively.

0.4 part by weight of a fine powder of a hydrophobic silica "Aerosil R-972" (manufactured by Aerosil Co., Ltd.) was added and mixed with 100 parts by weight of this capsulated toner to prepare the toner composition according to the present invention. This toner composition was designated as toner 3.

COMPARATIVE EXAMPLE 1

The procedure of Example 1 was repeated up to the surface treatment, except that no dimethylaminoethyl methacrylate was used and the 2-ethylhexyl acrylate was used in an amount of 30 parts by weight, thereby preparing a toner composition containing a capsulated toner. This toner composition was designated as comparative toner 1. The glass transition point of the resin in the core material of the capsulated toner and the softening point of the capsulated toner were 30.2° C. and 130.0° C., respectively.

COMPARATIVE EXAMPLE 2

The procedure of Example 3 was repeated up to the surface treatment, except that no dimethylaminopropyl methacrylamide was used and the 2-ethylhexyl acrylate was used in an amount of 35 parts by weight, thereby preparing a toner composition containing a capsulated toner. This toner composition was designated as comparative toner 2. The glass transition point of the resin in the core material of the capsulated toner and the softening point of the capsulated toner were 33.5° C. and 130.5° C., respectively.

COMPARATIVE EXAMPLE 3

The procedure of Example 1 was repeated up to the surface treatment, except that no dimethylaminoethyl methacrylate was used, the 2-ethylhexyl acrylate was used in an amount of 30 parts by weight and 21.6 g of neopentyl glycol was used instead of 22.0 g of resorcin and 3.6 g of neopentyl glycol, thereby preparing a toner composition containing a capsulated toner. This toner composition was designated as comparative toner 3. The glass transition point of the resin in the core material of the capsulated toner and the softening point of the capsulated toner were 30.2° C. and 137.0° C., respectively.

10 parts by weight of each of the toner compositions respectively prepared in the above-described Examples and Comparative Examples (toner 1, 2 and 3, comparative toner 1,2 and 3) and 90 parts by weight of a spherical ferrite powder having a particle size of 250 to 400 mesh and coated with a methylphenyl silicone resin as a carrier were placed in a polyethylene container, and each toner composition and the ferrite powder were subjected to rotational mixing together with the container at a number of revolutions of 150 rpm for 20 min, thereby preparing developing agents.

The resultant developing agents were subjected to evaluation on the amount of electrification and fixation.

The amount of electrification was measured by means of a blow-off electrification amount measuring apparatus. Specifically, use was made of a specific charge measuring apparatus equipped with a Farady cage, a capacitor and an electrometer. At the outset, W g (0.15 to 0.20 g) of the developing agent prepared above was placed in a measuring cell of brass equipped with a 500-mesh (properly variable to a size through which the carrier particle cannot pass) stainless mesh. After suction was conducted through a suction port for 5 sec, blowing was conducted for 5 sec by applying such a pressure that an air pressure regulator indicated a value of 0.6 kgf/cm$^2$, thereby removing only the toner composition from the cell.

During the blowing, the voltage was measured by an electrometer. The voltage of an electrometer determined 2 sec after the initiation of the blowing was taken as V (volt). In this case, when the electric capacity of the capacitor is taken as C ($\mu$F), the specific charge of the toner, Q/m, can be determined according to the following equation.

$$Q/m\ (\mu c/g) = \frac{C \times V}{m}$$

wherein m represents the weight of toner composition contained in W (g) of the development agent. When the weight of the toner composition in the developing agent and the weight of the developing agent are T (g) and D (g), respectively, the toner composition concentration of the sample is represented by the formula T/D×100 (%) and the m value can be determined according to the following equation.

$$m\ (g) = W \cdot T/D$$

The results of the measurement of the amount of electrification for a developing agent prepared under usual environment and a developing agent prepared after the capsulated toner composition alone was allowed to stand under high-temperature and high-humidity conditions for 24 hr are given in Table 1.

The fixation was evaluated by the following method. Specifically, the developing agents prepared above was subjected to the formation of an image through the use of a commercially available electrophotographic copying machine (wherein the photoreceptor comprised an organic photoconductor, the rotational speed of the fixation roller was 255 mm/sec, the heat pressure temperature in the fixation apparatus was made variable, and the oil coating apparatus was omitted). The fixation temperature was regulated to 100° to 220° C. to evaluate the fixation of the image and the offset resistance. The results are given in Table 2.

The term "lowest fixation temperature" used herein is intended to mean a fixing roller temperature determined as follows. A load of 500 g is placed on a sand eraser having a bottom face size of 15 mm×7.5 mm. The surface of an image fixed through a fixation machine is rubbed by the eraser reciprocatingly five times. The optical reflection density is measured by means of a Mcbeth densitometer before and after the rubbing, and the fixation roller temperature at which the percentage fixation defined by the following equation exceeds 70% is determined as the lowest fixation temperature.

$$\text{Percentage fixation} = \frac{\text{image density after rubbing}}{\text{image density before rubbing}} \times 100$$

The "low temperature offset disappearance temperature" is determined as follows. An unfixed image was formed within a copying machine, and a test was conducted on a fixation temperature region by means of an external fixing machine. In the fixing roller of the external fixing machine, both upper and lower rollers were coated with a high heat resistant silicone rubber, and a heater was provided within the upper roller. Toner images formed by the above-described individual developing agents transferred on a transfer paper having a basis weight of 64 g/m$^2$ under environmental conditions of a temperature of 20° C. and a relative humidity of 20% were fixed at a linear velocity of 115 mm/sec by means of a heat roller fixing apparatus which was conducted by the stepwise raising of the set temperature of the heat roller from 120° C. In the resultant fixed image, a solid toner having a size of 2 cm×2 cm was folded in two, and the folded portion was inspected with the naked eye to determine the toner was fixed or not. The minimum preset temperature necessary for obtaining a fixed image was determined. This temperature was viewed as the low temperature offset disappearance temperature. The heat roller fixing apparatus is one not equipped with a silicone oil feed mechanism.

The "high temperature offset generation temperature" is determined as follows. According to the above-described measurement of the minimum fixing temperature, a toner image was transferred, a fixation treatment was conducted by means of the above-described heat roller fixing apparatus, and a transfer paper having a white color was fed to the above-described heat roller fixing apparatus under the same conditions to determine with the naked eye whether or not toner staining occurred. The above-described procedure was repeated in such a manner that the preset temperature of the heat roller of the above-described heat roller fixing apparatus was successively raised, thereby determining the minimum preset temperature at which the toner staining occurred. The minimum present temperature was viewed as the high temperature offset generation temperature.

Regarding the blocking resistance, the degree of occurrence of agglomeration when each toner composition was allowed to stand for 24 hr under conditions of a temperature of 50° C. and a relative humidity of 40% was evaluated, and the results are also given in Table 2.

Further, the continuous copying test was conducted through the use of the commercially available electrophotographic copying machine used for determining the lowest fixation temperature.

TABLE 1

| | Amt. of electrification (μc/g) | | Retention of |
|---|---|---|---|
| | usual environment conditions ① 23° C., 50% RH) | high temp. and high humidity conditions ② 35° C., 85% RH) | amt. of electrification ②/① × 100 (%) |
| toner 1 | 19.5 | 18.0 | 92 |
| toner 2 | 17.5 | 16.0 | 91 |
| toner 3 | 20.0 | 18.5 | 93 |
| comp. toner 1 | 10.2 | 5.0 | 49 |
| comp. toner 2 | 11.5 | 5.5 | 48 |

TABLE 2

| | Lowest fixation temp. (°C.) | Low temp. offset disappearance temp. (°C.) | High temp. offset generation temp. (°C.) | Blocking resistance |
|---|---|---|---|---|
| toner 1 | 120 | 105 | 220< | good |
| toner 2 | 118 | 105 | 220< | good |
| toner 3 | 120 | 105 | 220< | good |
| comp. toner 1 | 115 | 100 | 220< | good |
| comp. toner 2 | 118 | 105 | 220< | good |
| comp. toner 3 | 170 | 110 | 220< | good |

As is apparent from Table 1, in the toners 1 to 3 according to the present invention, the amount of electrification was proper, and a good image could be maintained even after continuous copying of 50000 sheets of paper. Further, even under high temperature and high humidity conditions, the retention of the amount of electrification was high and the image was good. On the other hand, in the comparative toners 1 and 2, the amount of electrification of the comparative toners 1 and 2 was low, and greasing occurred during continuous copying under the ordinary condition. Further, also under high temperature and high humidity conditions, the amount of electrification was so low that greasing occurred during continuous copying, and the scattering of the toner occurred within the machine.

As is apparent from Table 2, the toners 1 to 3 and comparative toners 1 and 2 was low in the lowest fixation temperature, exhibited a broad non-offset region and created no problem on the blocking resistance by virtue of the fact that the outer shell comprised a resin having a thermally dissociable bond occupying 30% and more of the total number of bonds in which the isocyanate group and/or isothiocyanate group are involved. On the other hand, the comparative toner 3 was high in the lowest fixation temperature although it brought about no problem on the non-offset region and blocking resistance.

The invention being thus described, it will be obvious that the same may be varied in many ways. Such variations are not to be regarded as a departure from the spirit and acope of the invention, and all such modifications as would be obvious to one skilled in the art are intended to be included within the scope of the following claims.

What we claim:

1. A capsulated toner for heat pressure fixation comprising a heat-meltable core material and an outer shell, wherein said core material contains a colorant and a thermoplastic resin produced by copolymerizing 0.5 to 20% by weight of (A) an α,β-ethylenically copolymerizable monomer having a amino group and 99.95 to 80% by weight of (B) α,β-ethylenically copolymerizable monomer other than (A), wherein the percentages of components (A) and (B) are based on the total weight of components (A) and (B);

wherein said outer shell, being provided to cover the surface of the core material, comprises a resin produced by reacting (1) a monoisocyanate compound or a monoisothiocyanate compound or a mixture thereof in an amount of 0 to 30% by mole;

(2) a di- or higher isocyanate compound, a di- or higher isothiocyanate compound, or a mixture thereof in an amount of 100 to 70% by mole;

(3) a compound having one active hydrogen reactive with an isocyanate group, an isothiocyanate group, or a mixture thereof, in an amount of 0 to 30% by mole; and (4) a compound having two or more active hydrogens reactive with an isocyanate group, an isothiocyanate group, or a mixture thereof, in an amount of 100 to 70% by mole; wherein the mole percentages of components (1) and (2) are based upon the total moles components of (1) and (2), and wherein the mole percentages of components (3) and (4) are based upon the total moles of (3) and (4); wherein components (1), (2), (3), and (4) are present in such a proportion that the ratio of the total number of moles of components (1) and (2) to the total number of moles of the components (3) and (4) is in the range of from 1:1 to 1:20, and wherein said resin has a thermally dissociable bond occupying 30% or more of the total number of bonds in which the isocyanate group, isothiocyanate group or combination thereof, are involved.

2. The capsulated toner for heat pressure fixation according to claim 1, wherein said thermally dissociable bond is a bond derived from a reaction of a phenolic hydroxyl group and/or a thiol group with an isocyanate group and/or an isothiocyanate group.

3. The capsulated toner for heat pressure fixation according to claim 1, wherein said thermoplastic resin has a glass transition temperature of 10° to 50° C.

4. The capsulated toner for heat pressure fixation according to claim 1, wherein said capsulated toner has a softening point of 80° to 150° C.

5. The capsulated toner for heat pressure fixation according to claim 1, wherein said thermally dissociable bond is a bond derived from a reaction of a phenolic hydroxyl group of at least one compound selected from the group consisting of compounds represented by the following formulae (I) to (III) and/or a thiol group with an isocyanate group and/or an isothiocyanate group:

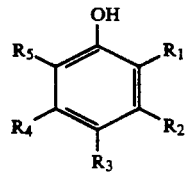

(I)

wherein $R_1$, $R_2$, $R_3$, $R_4$ and $R_5$ each independently stand for hydrogen atom, an alkyl group having 1 to 9 carbon atoms, an alkenyl group having 1 to 9 carbon atoms, an alkoxy group having 1 to 9 carbon atoms, an alkanoyl group having 1 to 9 carbon atoms, a carboalkoxy group having 2 to 9 carbon atoms, an aryl group having 6 to 9 carbon atoms or a halogen atom;

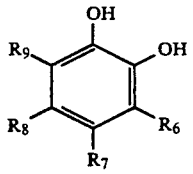

(II)

wherein $R_6$, $R_7$, $R_8$ and $R_9$ each independently stand for hydrogen atom, an alkyl group having 1 to 6 carbon atoms, an alkenyl group having 1 to 6 carbon atoms, an alkoxy group having 1 to 6 carbon atoms, an alkanoyl group having 1 to 6 carbon atoms, a carboalkoxy group having 2 to 6 carbon atoms, an aryl group having 6 carbon atoms or a halogen atom; and

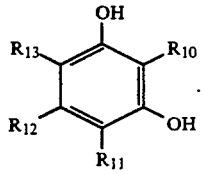

(III)

wherein $R_{10}$, $R_{11}$, $R_{12}$ and $R_{13}$ each independently stand for hydrogen atom, an alkyl group having 1 to 6 carbon atoms, an alkenyl group having 1 to 6 carbon atoms, an alkoxy group having 1 to 6 carbon atoms, an alkanoyl group having 1 to 6 carbon atoms, a carboalkoxy group having 2 to 6 carbon atoms, an aryl group having 6 carbon atoms or a halogen atom.

6. The capsulated toner for heat pressure fixation according to claim 1, wherein said thermally dissociable bond is a bond derived from a reaction of a phenolic hydroxyl group and/or a thiol group with an aromatic isocyanate group and/or an isothiocyanate group.

7. The capsulated toner for heat pressure fixation according to claim 1, wherein said amino group of component (A) is a tertiary amino group.

8. The capsulated toner for heat pressure fixation according to claim 1, wherein said component (A) is selected from the group consisting of dimethylaminoethyl methacrylate, diethylaminoethylmethacrylate, dimethylaminopropyl methacrylamide, 2-vinylpyridine, 4-vinylpyridine, 1-vinylimidazole, 1-vinyl-2-pyrrolidinone, N-vinyl-2-pyrrolidone, and 9-vinyl carbazole.

9. The capsulated toner for heat pressure fixation according to claim 1, wherein said component (B) is selected from the group consisting of o-methylstyrene, m-methylstyrene, p-methylstyrene, α-methylstyrene, p-ethylstyrene, 2,4-dimethylstyrene, p-chlorostyrene, vinylnaphthalene, ethylene, propylene, butylene, isobutylene, vinyl chloride, vinyl bromide, vinyl fluoride, vinyl acetate, vinyl propionate, vinyl formate, vinyl caproate, acrylic acid, methyl acrylate, ethyl acrylate, n-propyl acrylate, isopropyl acrylate, n-butyl acrylate, isobutyl acrylate, tert-butyl acrylate, amyl acrylate, cyclohexyl acrylate, n-octyl acrylate, isooctyl acrylate, decyl acrylate, lauryl acrylate, 2-ethylhexyl acrylate, stearyl acrylate, methoxyethyl acrylate, 2-hydroxyethyl acrylate, glycidyl acrylate, 2-chloroethyl acrylate, phenyl acrylate, methyl α-chloroacrylate, methacrylic acid, methyl methacrylate, ethyl methacrylate, n-propyl methacrylate, isopropyl methacrylate, n-butyl methacrylate, isobutyl methacrylate, tert-butyl methacrylate, amyl methacrylate, cyclohexyl methacrylate, n-octyl methacrylate, isooctyl methacrylate, decyl methacrylate, lauryl methacrylate, 2-ethylhexyl methacrylate, stearyl methacrylate, methoxyethyl methacrylate, 2-hydroxyethyl methacrylate, glycidyl methacrylate, phenyl methacrylate, acrylonitrile, methacrylonitrile, acrylamide, dimethyl maleate, vinyl methyl ketone, vinyl ethyl ether, and vinylidene chloride.

10. The capsulated toner for heat pressure fixation according to claim 1, wherein said monoisocyanate compound (1) is selected from the group consisting of ethyl isocyanate, octyl isocyanate, 2-chloroethyl isocyanate, chlorosulfonyl isocyanate, n-dodecyl isocyanate, butyl isocyanate, n-hexyl isocyanate, lauryl isocyanate, phenyl isocyanate, m-chlorophenyl isocyanate, 4-chlorophenyl isocyanate, p-cyanophenyl isocyanate, 3,4-dichlorophenyl isocyanate, o-tolyl isocyanate, m-tolyl isocyanate, p-tolyl isocyanate, p-toluenesulfonyl isocyanate, 1-naphthyl isocyanate, o-nitrophenyl isocyanate, m-nitrophenyl isocyanate, p-nitrophenyl isocyanate, phenyl isocyanate, p-bromophenyl isocyanate, o-methoxyphenyl isocyanate, m-methoxyphenyl isocyanate, p-methoxyphenyl isocyanate, ethyl isocyanatoacetate, butyl isocyanatoacetate and trichloroacetyl isocyanate.

11. The capsulated toner for heat pressure fixation according to claim 1, wherein said di- or higher isocyanate compound (2) is selected from the group consisting of 2,4-tolylene diisocyanate, a dimer of 2,4-tolylene diisocyanate, 2,6-tolylene diisocyanate, p-xylylene diisocyanate, m-xylylene diisocyanate, 4,4'-diphenylmethane diisocyanate, 1,5-naphthylene diisocyanate, 3,3'-dimethyldiphenyl-4,4'-diisocyanate, 3,3'-dimethyldiphenylmethane-4,4'-diisocyanate, m-phenylene diisocyanate, triphenylmethane-triisocyanate, polymethylenephenyl isocyanate, hexamethylene diisocyanate, trimethylhexamethylene diisocyanate, lysine diisocyanate, dimer acid diisocyanate, isophorone diisocyanate, 4,4'-methylenebis(cyclohexylisocyanate), methylcyclohexane-2,4-(or 2,6-)diisocyanate, 1,3-(isocyanatemethyl)cyclohexane, and an adduct of 3 moles of tolylene diisocyanate with one mole of trimetylolpropane.

12. The capsulated toner for heat pressure fixation according to claim 1, wherein said compound having one active hydrogen reactive with an isocyanate group, isothiocyanate group, or mixture thereof (3) is selected from the group consisting of methyl alcohol, ethyl alcohol, n-propyl alcohol, isopropyl alcohol, n-butyl alcohol, isobutyl alcohol, tert-butyl alcohol, pentyl alcohol, hexyl alcohol, cyclohexyl alcohol, heptyl alcohol, octyl alcohol, nonyl alcohol, decyl alcohol, lauryl alcohol, stearyl alcohol, phenol, o-cresol, m-cresol, p-cresol, 4-n-butyl phenol, 2-sec-butyl phenol, 2-tert-butyl phenol, isononyl phenol, 2-propenyl phenol, 3-propenyl phenol, 3-tert-butyl phenol, 4-tert-butyl phenol, nonyl phenol, 4-propenyl phenol, 2-methoxy phenol, 3-methoxy phenol, 4-methoxy phenol, 3-acetyl phenol, 3-carbomethoxy phenol, 2-chlorophenol, 3-chlorophenol, 4-chlorophenol, 2-bromophenol, 3-bromophenol, 4-bromophenol, benzyl alcohol, 1-naphthol, 2-naphthol, 2-acetyl-1-naphthol and ε-caprolactam.

13. The capsulated toner for heat pressure fixation according to claim 1, wherein said compound having two or more active hydrogens reactive with an isocyanate group, an isothiocyanate group, or mixture thereof (4) is selected from the group consisting of catechol, resorcin, hydroquinone, 4-methylcatechol, 4-tert-butylcatechol, 4-acetylcatechol, 3-methoxycatechol, 4-phenylcatechol, 4-methylresorcin, 4-ethylresorcin, 4-tert-butyl-resorcin, 4-hexyl-resorcin, 4-chlororesorcin, 4-benzylresorcin, 4-acetylresorcin, 4-carbomethoxyresorcin, 2-methylresorcin, 5-methylresorcin, tert-butylhydroquinone, 2,5-di-tert-butylhydroquinone, 2,5-di-tertamyl-hydroquinone, tetramethylhydroquinone, tetrachlorohydroquinone, methylcarboaminohydroquinone, methylureidohydroquinone, benzonorbornene-3,6-diol, bisphenol A, bisphenol S, 3,3'-dichlorobisphenol S, 2,2'-dihydroxybenzophenone, 2,4-dihydroxybenzophenone, 4,4'-dihydroxybenzophenone, 2,2'-dihydroxydiphenyl, 4,4'-dihydroxydiphenyl, 2,2'-dihydroxydiphenylmethane, 3,4-bis(p-hydroxyphenyl)hexane, 1,4-bis(p-hydroxyphenyl)propyl)benzene, bis(4-hydroxyphenyl)methylamine, 1,3-dihydroxynaphthalene, 1,4-dihydroxynaphthalene, 1,5-dihydroxynaphthalene, 2,6-dihydroxynaphthalene, 1,5-dihydroxyanthraquinone, 2-hydroxybenzyl alcohol, 4-hydroxybenzyl alcohol, 2-hydroxy-3,5-di-tert-butylbenzyl alcohol, 4-hydroxy-3,5-di-tert-butylbenzyl alcohol, 4-hydroxyphenethyl alcohol, 2-hydroxyethyl-4-hydroxybenzoate, 2-hydroxyethyl-4-hydroxyphenyl acetate, resorcin mono-2-hydroxyethyl ether, hydroxyhydroquinone, gallic acid and ethyl 3,4,5-trihydroxybenzoate.

14. The capsulated toner for heat pressure fixation according to claim 1, comprising a heat-meltable core material and an outer shell, wherein said core material contains a colorant and a thermoplastic resin, produced by copolymerising 0.05 to 20% by weight of (A) an $\alpha,\beta$-ethylenically copolymerizable monomer having an amino group, 99.95 to 80% by weight of (B) an $\alpha,\beta$-ethylenically copolymerizable monomer other than (A), and 0.001 to 15% by weight of a crosslinking agent, wherein the above percentages are based upon the total weight of components (A) and (B), said outer shell being provided to cover the surface of the core material.

15. A toner composition for heat pressure fixation comprising the capsulated toner as set forth in claims 1 or 9 and a fine powder of a hydrophobic silica.

16. The capsulated toner for heat pressure fixation according to claim 14, wherein said crosslinking agent is selected from the group consisting of divinylbenzene, divinylnaphthalene, polyethylene glycol dimethacrylate, diethylene glycol diacrylate, triethylene glycol diacrylate, 1,3-butylene glycol dimethacrylate, 1,6-hexylene glycol dimethacrylate, neopentyl glycol dimethacrylate, dipropylene glycol dimethacrylate, polypropylene glycol demethacrylate, 2,2'-bis(4-methacryloxydiethoxyphenyl)propane, 2,2'-bis(4-acryloxydiethoxyphenyl)propane, trimethylolpropane trimethacrylate, trimethylolpropanetriacrylate, tetramethylolmethanetetraacrylate, bromoneopentyl glycol dimethacrylate and diallyl phthalate.

17. The capsulated toner for heat pressure fixation according to claim 14, wherein said crosslinking agent is present in an amount of 0.1 to 10% by weight, based upon the total weight of (A) and (B).

* * * * *